US006568204B2

(12) United States Patent
Fisk et al.

(10) Patent No.: US 6,568,204 B2
(45) Date of Patent: May 27, 2003

(54) BAFFLE CONNECTION FOR AN ACCUMULATOR AND RELATED METHOD OF MANUFACTURING

(75) Inventors: John Dale Fisk, Edon, OH (US); Chhotu N. Patel, Farmington Hills, MI (US)

(73) Assignee: Automotive Fluid Systems, Inc., Troy, MI (US)

( * ) Notice: Subject to any disclaimer, the term of this patent is extended or adjusted under 35 U.S.C. 154(b) by 0 days.

(21) Appl. No.: 10/012,123

(22) Filed: Oct. 30, 2001

(65) Prior Publication Data

US 2003/0079497 A1 May 1, 2003

(51) Int. Cl.[7] ..... F25B 39/04; F25B 43/00
(52) U.S. Cl. ..... 62/503; 62/509; 29/890.06
(58) Field of Search ..... 62/503, 83, 509; 29/890.06; 55/413, 465

(56) References Cited

U.S. PATENT DOCUMENTS

| | | | | |
|---|---|---|---|---|
| 1,738,915 A | | 12/1929 | Mueller | |
| 3,754,409 A | | 8/1973 | Wreen, Jr. et al. | |
| 4,111,005 A | | 9/1978 | Livesay | |
| 4,162,692 A | | 7/1979 | Greer et al. | |
| 4,432,393 A | | 2/1984 | Mills | |
| 4,474,035 A | | 10/1984 | Amin et al. | |
| 4,627,247 A | | 12/1986 | Morse | |
| 4,768,355 A | | 9/1988 | Breuhan et al. | |
| 4,800,737 A | | 1/1989 | Smith et al. | |
| 5,075,967 A | | 12/1991 | Bottum | |
| 5,184,479 A | | 2/1993 | Koberstein et al. | |
| 5,184,480 A | | 2/1993 | Kolpacke | |
| 5,245,842 A | | 9/1993 | Searfoss et al. | |
| 5,375,327 A | | 12/1994 | Searfoss et al. | |
| 5,435,153 A | * | 7/1995 | Hutchison et al. | 62/474 |
| 5,479,790 A | | 1/1996 | Bottum, Jr. et al. | |
| 5,507,159 A | | 4/1996 | Cooksey | |
| 5,596,882 A | * | 1/1997 | Hutchison et al. | 62/503 |
| 5,651,266 A | * | 7/1997 | Hutchison et al. | 62/474 |
| 5,746,065 A | | 5/1998 | Patel et al. | |
| 5,778,697 A | * | 7/1998 | Wantuck | 62/503 |
| 5,855,293 A | | 1/1999 | Slais | |
| 5,904,055 A | | 5/1999 | Slais | |
| 6,167,720 B1 | * | 1/2002 | Chisnell | 62/474 |
| 6,438,972 B1 | * | 8/2002 | Picket, Jr. et al. | 62/85 |

* cited by examiner

*Primary Examiner*—Denise L. Esquivel
*Assistant Examiner*—Marc Norman
(74) *Attorney, Agent, or Firm*—Vanophem & Vanophem, P.C.

(57) ABSTRACT

An accumulator having an improved baffle connection and a related method of interlocking an outlet tube and baffle within annular grooves of a passage of an enclosure to prevent blow by of liquid refrigerant fluid past the baffle connection. The baffle includes a cylindrical extension having a mounting passage through which an outlet tube extends. The cylindrical extension and outlet tube extend into the passage of the enclosure and are engaged within one or more of the annular grooves of the enclosure to interlock the baffle and outlet tube to the enclosure. The enclosure preferably includes a puck having the passage therethrough, where the puck is inserted into a canister and then welded thereto.

13 Claims, 2 Drawing Sheets

BAFFLE CONNECTION FOR AN ACCUMULATOR AND RELATED METHOD OF MANUFACTURING

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to air-conditioning systems and componentry. More specifically, this invention is directed to a refrigerant accumulator and a related method of manufacturing, wherein a suction tube and a baffle are integrally interlocked to a puck-like enclosure member of the accumulator to simplify assembly, improve reliability, and reduce the overall cost of the accumulator.

2. Description of the Related Art

Refrigerant accumulators are well known and widely used in various vehicle air-conditioning systems to separate liquid refrigerant from gaseous refrigerant. Many accumulators are constructed from an open-ended canister with a closure member assembled and welded to the open end thereof. Typically, a J-shaped suction tube and baffle assembly is brazed or welded in an outlet passage of the closure member before the closure member is assembled and welded to the open-ended canister. The prior art has suggested a couple of exceptions to this practice.

First, U.S. Pat. No. 3,754,409 to Wreen, Jr. et al. teaches a liquid trapping suction accumulator intentionally lacking a baffle to minimize pressure drop in the air conditioning system and thus increase the efficiency thereof. Wreen, Jr. et al. disclose the accumulator as having a cylindrical casing with bottom and top enclosures. The top enclosure includes an outlet port therethrough with a cylindrical outlet connector positioned therein. Within the accumulator there is a J-shaped suction tube that is supported from below at a bight portion thereof by a bracket. The suction tube is mounted to the top closure within the outlet connector such that the outside diameter of the upper end of the suction tube is fit within the inside diameter of the outlet connector. The outlet connector is staked with dimples and the upper end of the suction tube is flared into the dimples to rigidly connect the suction tube within the outlet connector. Spaces between the dimples define a predetermined open area to permit gas to exit the accumulator.

Second, U.S. Pat. No. 5,746,065 to Patel et al. teaches a novel connection of a baffle within an accumulator canister. Patel et al. disclose that the baffle connection includes an outlet passage in an accumulator closure member or puck. The outlet passage includes a cylindrical bushing having a first end fitted into the outlet passage and further having a second end extending into the interior of the accumulator. Additionally, the baffle includes a cylindrical extension with a passage therethrough through which an outlet end of an outlet tube is fitted. The outlet end of the tube is knurled and the cylindrical extension of the baffle is melted into the knurling to enhance the seal therebetween. The cylindrical extension and outlet end of the outlet tube are fitted within the second end of the bushing, wherein the second end of the bushing is crimped over the outlet tube and baffle.

Unfortunately, the above-mentioned approaches have at least one major disadvantage. Both require use of an intermediate connector or bushing between the outlet end of the suction tube and the outlet passage of the closure member of the accumulator. The intermediate connector or bushing represents an unnecessary expense in terms of extra part cost and extra labor cost to handle and assemble.

From the above, it can be appreciated that prior art structure and methods of connecting the outlet end of a suction tube to the outlet passage of a closure member of an accumulator are not fully optimized. Therefore, what is needed is an accumulator having a simplified connection for a suction tube to an enclosure.

BRIEF SUMMARY OF THE INVENTION

According to the preferred embodiment of the present invention, there is provided an accumulator for an air-conditioning system. The accumulator includes an enclosure, a baffle, and a tubular member. An outlet passage extends through a portion of the enclosure and includes a series of annular grooves. The baffle includes an extension portion having a mounting passage extending therethrough. The extension portion extends into the outlet passage of the enclosure and engages within one or more of the annular grooves of the enclosure to interlock the baffle to the enclosure. The tubular member includes an end portion that extends through the mounting passage of the extension portion of the baffle. The end portion of the tubular member further extends into the outlet passage of the enclosure and engages one or more of the annular grooves to interlock the tubular member to the enclosure. Preferably, but not necessarily, the enclosure includes a puck having the outlet passage wherein the puck is then inserted into a second enclosure, namely a canister, and is then welded thereto.

In another aspect of the present invention a method of manufacturing an accumulator for an air-conditioning system is provided. The method includes the following steps. An enclosure is manufactured that includes a passage therethrough and a depression in the passage. A baffle is assembled over an end of a tube wherein the baffle includes an extension portion that circumscribes the tube. A portion of the tube is inserted into the passage of the enclosure such that a portion of the extension portion also extends into the passage of the enclosure. Part of the end portion of the tube and at least part of the extension portion of the baffle are deformed into engagement with the depression of the enclosure to form a subassembly of the accumulator. Thus, the tube and extension portion of the baffle are mechanically interlocked to the enclosure.

Accordingly, it is an object of the present invention to provide an accumulator having a baffle circumscribing an outlet tube and interlocking to an enclosure.

It is another object of the present invention to improve the design of an accumulator baffle connection and eliminate the problems associated with prior art connection methods used for connecting the baffle within the enclosure.

It is yet another object of the present invention to provide an accumulator having a baffle connection wherein the baffle, outlet tube, and desiccant bag are all connected to the puck of the accumulator to form a subassembly, and then the subassembly is inserted into and welded to a canister.

It is still another object of the present invention to provide a seal between the baffle and the puck thereby improving the performance of an accumulator.

It is a further object of the present invention to provide an accumulator that overcomes the problems of the prior art, has a lower overall cost and is easier to manufacture by reducing part count and simplifying the design and assembly.

It is yet a further object of the present invention to provide a mechanical interlock achieved by flowing tube and baffle material into depressions within an enclosure to prevent blow by of liquid refrigerant fluid past the baffle connection.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
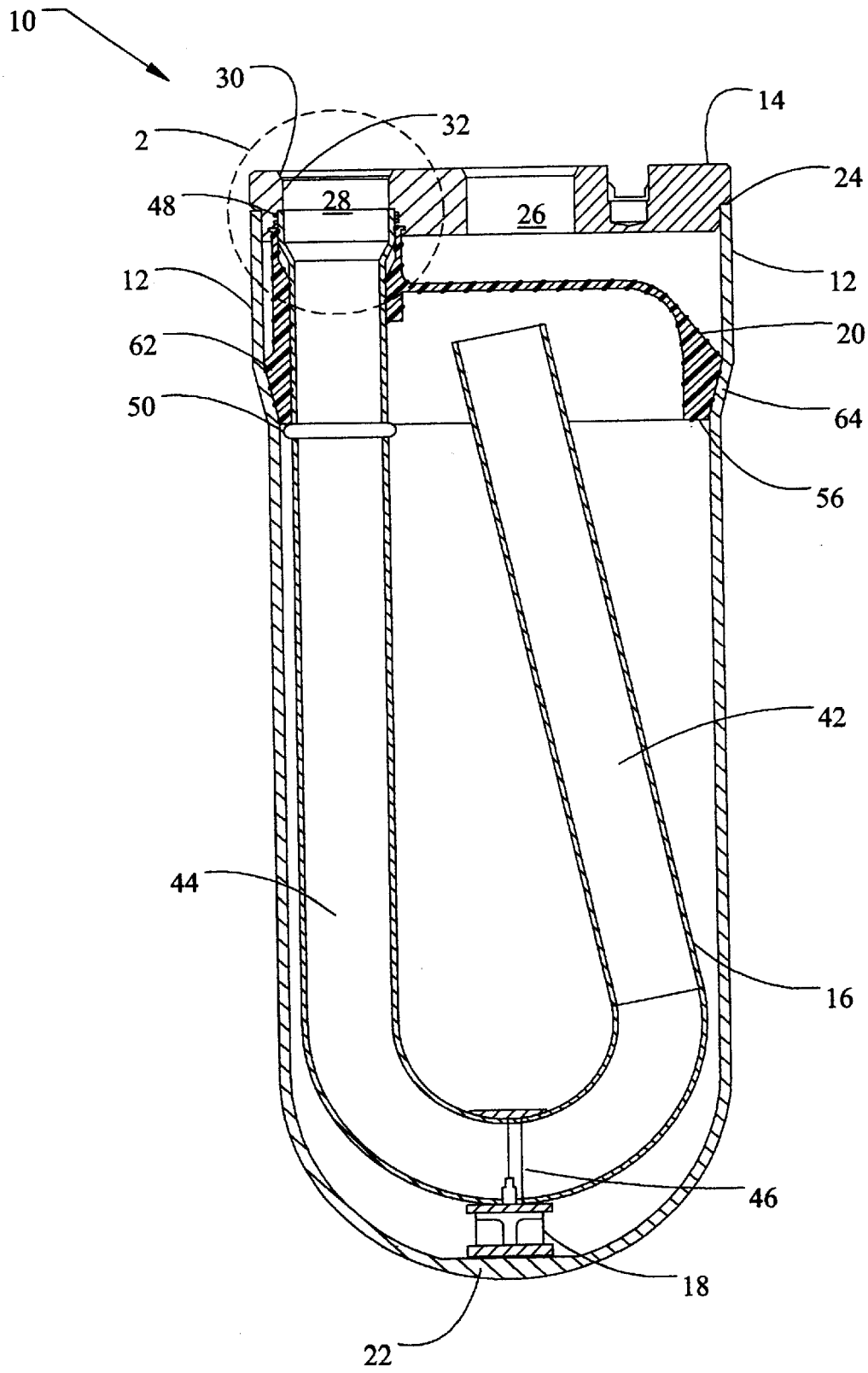
FIG. 1 is a cross-sectional view of an accumulator having a baffle connection according to the preferred embodiment of the present invention.

Referring to FIG. 1, there is shown an accumulator 10 according to the present invention for use in an air-conditioning system. Separate enclosures are assembled together, namely a housing or canister 12 and a closure member or puck 14, to create the sealed accumulator 10. Internal components are disposed within the accumulator 10, namely a J-tube or outlet tube 16 with a pickup filter 18 attached thereto, and a deflector or baffle 20. Although not shown here, a desiccant bag is typically fastened to the outlet tube 16. It is contemplated that the accumulator 10 could also be constructed of an integral puck and canister having an open bottom end, wherein the internal components are assembled through the open bottom end and thereafter the open bottom end is spun closed.

Refrigeration accumulators are generally well known in the art to be composed of a variety of different materials and manufactured using a variety of different processes. Nonetheless, the canister 12 is preferably composed of a light material such as aluminum and is manufactured using a deep draw process resulting in a closed bottom end 22 and an open top end 24. The puck 14 is also preferably composed of aluminum and is manufactured by machining processes. The baffle 20 is preferably injection molded from a thermoplastic material, preferably Nylon 408L.

Figure 2:
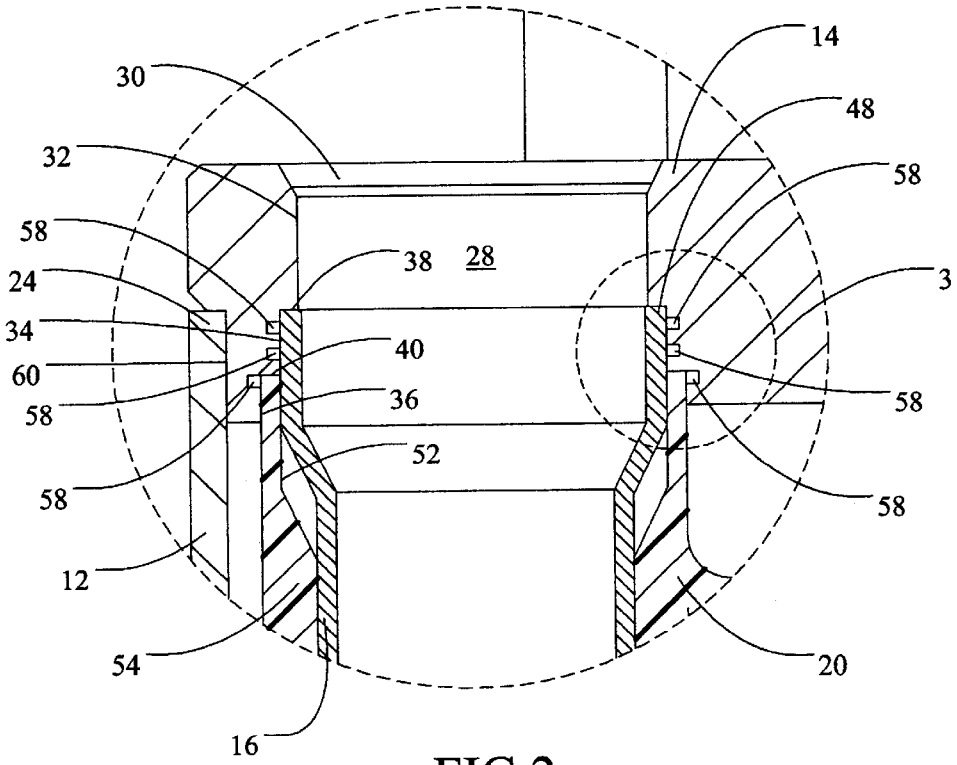
FIG. 2 is an enlarged view of circle 2 of FIG. 1 wherein an outlet tube and baffle are shown in a pre-fastened state with respect to an enclosure member of the accumulator.

As best shown in FIGS. 1 and 2, the puck 14 includes an inlet passage 26 and an outlet passage 28 therethrough. The outlet passage 28 includes a chamfer 30, a main passage 32, and first and second counterbores 34 and 36. The main passage 32 and first counterbore 34 define a first shoulder 38 therebetween, and the first counterbore 34 and second counterbore 36 define a second shoulder 40 therebetween.

It is preferable to assemble the baffle 20 to the outlet tube 16 prior to fastening the outlet tube 16 and baffle 20 to the puck 14. The outlet tube 16 is provided with an inlet leg 42, an outlet leg 44, and a bight portion 46 therebetween with the pickup filter 18 mounted to the bight portion 46. Spaced a distance away from an upper end portion 48 of the outlet leg 44 there is provided an annular bead 50 as it is well known in the art to form. Before the upper end portion 48 of the outlet leg 44 is flared or expanded as shown, the baffle 20 is passed over the upper end portion 48 of the outlet tube 16. As such, the portion of the outlet leg 44 that is above the annular bead 50 extends through a mounting passage 52 of a cylindrical extension 54 of the baffle 20. A bottom locating edge 56 of the baffle 20 locates against the annular bead 50, as shown in FIG. 1.

Figure 3:
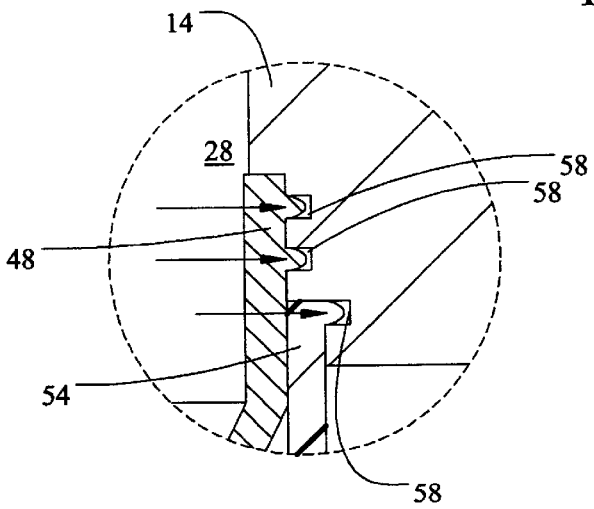
FIG. 3 is an enlarged view of circle 3 of FIG. 2 showing material of the outlet tube and baffle flowing into grooves of the enclosure member.
Figure 3A:
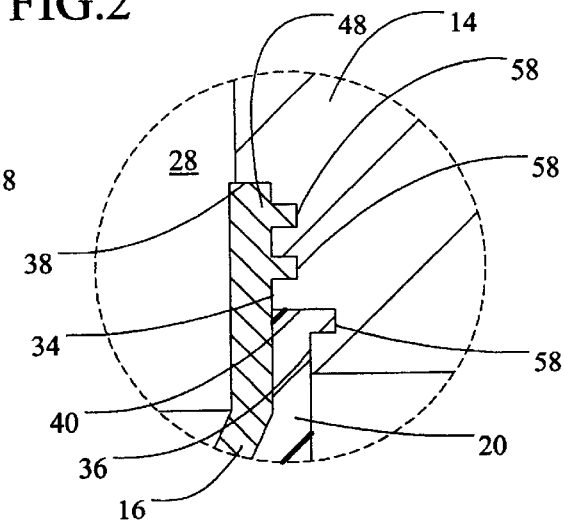
FIG. 3A is an enlarged and modified view of circle 3 of FIG. 2 now showing material of the outlet tube and baffle fully engaged with the grooves of the enclosure member.

Referring again to FIG. 2, the outlet tube 16 and baffle 20 are introduced into the outlet passage 28 of the puck 14 to be integrally fastened thereto. Specific fixturing of accumulator components for assembly is well within the ordinary skill in the art and need not be discussed in detail here. The connection of the outlet tube 16 and baffle 20 to the puck 14 is conducted in a three-step operation. First, the outlet tube 16 is flared outwardly as shown to mate with the first counterbore 34. Second, a first tool (not shown), such as a bullet nosed flaring or swaging tool is introduced within the outlet passage 28 of the puck 14 concentric with a portion of both the outlet tube 16 and the cylindrical extension 54 of the baffle 20. As the forming tool is axially inserted, it plastically displaces the material of both the outlet tube 16 and the baffle 20 to flow such material into one or more depressions or grooves 58 within the outlet passage 28 of the puck 14. Alternatively, and not shown, any part of the grooves 58 or second counterbore 36 can be serrated so as to bite into the plastic upon insertion of the forming tool to improve the strength of the mechanical connection. FIG. 3 illustrates the second step wherein the material of the upper end portion 48 and the cylindrical extension 54 flows into the grooves 58 of the puck. Third, the first tool is removed and a second, slightly larger swaging tool (not shown) is inserted in place of the first tool to complete the expansion of the outlet tube 16 and baffle 20 materials. Thus, FIG. 3A illustrates the third and final step wherein the material of the outlet tube 16 and baffle 20 is fully engaged and interlocked with the grooves 58 of the puck 14. Applicants conducted testing of this arrangement that resulted in an improved pullout force of 900 lbs., compared to the prior art pullout force of less than 200 lbs. Additionally, by expanding a portion of the baffle 20 into interlocked engagement with the puck 14, a fluid-tight seal is formed that is superior to that of the prior art.

FIG. 2 illustrates the puck 14 already assembled to the canister 12 before the outlet tube 16 and baffle 20 have been fastened to the puck 14. It is preferable, however, to fully fasten the outlet tube 16 and baffle 20 to the puck 14 as a subassembly before introducing the puck 14 to the canister 12. The subassembly consisting of the puck 14, outlet tube 16, and baffle 20 is thus inserted into the canister 12 such that a reduced diameter portion 60 of the puck 14 locates within the open top end 24 of the canister 12. Additionally, a tapered portion 62 at the lower end of the baffle 20 locates against a flared portion 64 of the canister 12, as shown in FIG. 1. This tapered interface between the baffle 20 and the canister 12 enables the baffle 20 to located square, or concentrically and perpendicularly to the centerline of the canister 12 during assembly and welding operations. As earlier disclosed, the puck 14 is then preferably MIG welded to the canister 12 about their respective circumferential intersecting peripheries to complete the assembly of the accumulator 10. The mechanical interlock achieved by flowing the material of the outlet tube 16 and baffle 20 into the grooves 58 within the puck 14 prevents blow by of liquid refrigerant fluid past the baffle connection.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Those skilled in the art will appreciate that other applications, including those outside of the automotive industry, are possible with this invention. Accordingly, the present invention is not limited to only automotive air-conditioning systems. Accordingly, the scope of the present invention is to be limited only by the following claims.

What is claimed is:

1. An accumulator for an air-conditioning system, said accumulator comprising:

means for creating a sealed enclosure, said means for creating a sealed enclosure having a passage extending therethrough, said means for creating a sealed enclosure having at least one depression within said passage;

a baffle having an extension portion, said extension portion having a mounting passage therethrough, said extension portion extending at least partially into said passage of said means for creating a sealed enclosure, a portion of said extension portion being engaged within said at least one depression of said means for creating a sealed enclosure in order to interlock said baffle to said means for creating a sealed enclosure; and a tubular member having an end portion, said end portion extending at least partially through said passage of said means for creating a sealed enclosure, part of said end portion being engaged within said at least one depression to interlock said tubular member to said means for creating a sealed enclosure.

2. The accumulator as claimed in claim 1, wherein said means for creating a sealed enclosure comprises a canister having an open end and further comprises a puck connected to said open end of said canister.

3. The accumulator as claimed in claim 2, wherein said passage of said means for creating a sealed enclosure extends through said puck and said passage comprises a smaller counterbore and a larger counterbore, said extension portion being engaged within said at least one depression in said larger counterbore and said end portion of said tubular member being engaged within said at least one depression in said smaller counterbore.

4. The accumulator as claimed in claim 3, wherein said tubular member comprises an annular bead portion and further wherein said baffle comprises a bottom locating edge substantially opposite said extension portion, said locating edge locating against said annular bead portion such that said baffle is trapped between said annular bead portion and said puck.

5. The accumulator as claimed in claim 3, wherein said canister comprises a flared portion, further wherein said baffle comprises a tapered portion located against said flared portion of said canister.

6. An accumulator for an air-conditioning system, said accumulator comprising:

a housing having a closure member with an outlet passage extending through said closure member, said outlet passage having a first counterbore, said outlet passage further having a second counterbore, said closure member having at least one annular groove within said first counterbore, said closure member further having at least one annular groove within said second counterbore;

a baffle having an extension portion, said extension portion having a mounting passage therethrough, said extension portion extending at least partially into said second counterbore of said housing and being engaged within said at least one annular groove of said second counterbore to sealingly interlock said baffle to said housing; and an outlet tube having an outlet end, said outlet end extending through said mounting passage of said extension portion of said baffle and further extending at least partially into said outlet passage of said closure member, at least part of said outlet end being engaged within said at least one annular groove of said first counterbore to interlock said outlet tube within said outlet passage of said closure member.

7. The accumulator as claimed in claim 6, wherein said housing comprises a deep drawn canister having an open end, said closure member further comprising a puck connected to said open end of said deep drawn canister.

8. The accumulator as claimed in claim 7, wherein said first counterbore includes two annular grooves disposed therewithin.

9. The accumulator as claimed in claim 8, wherein said outlet tube comprises an annular bead portion and further wherein said baffle comprises a bottom locating edge substantially opposite said extension portion, said locating edge locating against said annular bead portion such that said baffle is trapped between said annular bead portion and said puck.

10. The accumulator as claimed in claim 8, wherein said canister comprises a flared portion and further wherein said baffle comprises a tapered portion located against said flared portion of said canister.

11. A method of manufacturing an accumulator for an air-conditioning system, said method comprising the steps of:

manufacturing an enclosure having a passage therethrough, said enclosure having at least one depression in said passage;

assembling a baffle over an end of a tube, said baffle having an extension portion thereon circumscribing said tube;

inserting a portion of said tube at least partially into said passage of said enclosure such that a portion of said extension portion of said baffle also extends at least partially into said passage of said enclosure; and expanding at least part of said end portion of said tube and at least part of said extension portion of said baffle into engagement with said at least one depression of said enclosure to form a subassembly;

whereby said tube is mechanically interlocked to said enclosure and further whereby said extension portion of said baffle is mechanically interlocked to said enclosure.

12. The method as claimed in claim 11, further comprising the step of assembling said subassembly into a canister.

13. The method as claimed in claim 12, further comprising the step of welding a portion of said subassembly to said canister.

* * * * *